United States Patent [19]

Podolan et al.

[11] 4,241,542

[45] Dec. 30, 1980

[54] VEHICLE DOOR WINDOW ASSEMBLY

[75] Inventors: Edward G. Podolan; Francis C. Przybysz, both of Utica, Mich.

[73] Assignee: General Motors Corporation, Detroit, Mich.

[21] Appl. No.: 950,629

[22] Filed: Oct. 12, 1978

[51] Int. Cl.[3] ..... E05F 11/48

[52] U.S. Cl. ..... 49/352; 49/375

[58] Field of Search ..... 49/349, 352, 227, 375

[56] References Cited

U.S. PATENT DOCUMENTS

| | | | |
|---|---|---|---|
| 3,062,528 | 11/1962 | Martens | 49/227 |
| 3,868,788 | 3/1975 | Podolan | 49/349 |
| 4,004,371 | 1/1977 | Pololan et al. | 49/352 |

*Primary Examiner*—Kenneth Downey

*Attorney, Agent, or Firm*—R. L. Phillips

[57] ABSTRACT

A hard-top type vehicle door window assembly having a tape drive window regulator mechanism with a connector device which is guided on a straight slide pole and permits a change in angularity of the window as it is moved therealong with the window laterally stabilized as it approaches its closed position by cooperation of a stabilizing arrangement between the window and the door's inner panel and also between the connector device and the inner door panel.

4 Claims, 8 Drawing Figures

VEHICLE DOOR WINDOW ASSEMBLY

This invention relates to a vehicle door window assembly and more particularly to the lateral support of a window in a door of a hard-top type vehicle.

In hard-top type vehicles it is conventional practice to provide lateral stabilizatin of a door window when in its closed position using the outer door panel and the inner door panel which supports the window regulator mechanism. As a result, the outer panel must be of heavier construction than is otherwise required where the window slides in a frame integral with the door. Furthermore, there are continuing demands to reduce not only the weight but also the expense and the space required for the window regulator mechanism and it is recognized that substantial advances have been made in this area with the substitution of a tape drive window regulator mechanism for the more conventional linkage type window regulator.

According to the present invention, lateral stabilization of the window in its closed position is made possible without use of the outer door panel to thus reduce its weight and with a tape drive type of window regulator mechanism in an arrangement which is solely connected between the inner door panel and the window. The tape drive window regulator mechanism includes a track, a perforated tape slidably mounted in the track, an actuator assembly having a sprocket for engaging and driving the tape along the track and a pivotal connector device which connects the tape to the window. The pivotal connector device is guided on a straight slide pole which is secured to the inner door panel and extends parallel to the desired window movement. The pivotal connector device comprises a pair of yokes which are pivotally connected to permit change in the angularity between the window and the slide pole as the glass is guided near the end of its closing movement by a stabilizer bar that is secured to the inner door panel and engages a window guide that is secured to the window near its bottom edge. The window guide engages the stabilizer bar as the window approaches its closed position and forces the glass to bear against a perimeter seal on the vehicle body with such change in angularity between the glass and the slide pole permitted by the pivotal yoke arrangement between the tape and the window. In addition, the pivotal yoke of the connector mechanism which is secured to the window has a finger which engages an adjustable stabilizer finger secured to the inner door panel as the window approaches its closed position to laterally fix or stabilize the window against the perimeter seal in its closed position. Thus, no guide support of the window is required from the outer door panel to thus permit a reduction in its weight as compared with conventional arrangements of like kind. In addition, the slide pole is permitted to be made straight rather than curved to allow for the change in angularity of the glass as it is moved between its open and closed positions, such change in angularity not only being necessary for establishment of the sealing of its upper edge and front and rear edges but also for the change in angularity that must occur in moving a curved window between open and closed positions.

An object of the present invention is to provide a new and improved vehicle door window assembly.

Another object is to provide in a vehicle door window assembly, lateral stabilization of the window in its up position established from the door's inner panel.

Another object is to provide in a vehicle door window assembly, a tape drive window regulator mechanism having a connector device which is guided on a straight slide pole and permits change in angularity of the window as it is moved there along and wherein the window is laterally stabilized as it approaches its closed position by cooperation of a stabilizer arrangement between the window and inner door panel and also between the connector device and the inner door panel.

These and other objects of the present invention will be more apparent from the following description and drawings in which.

Figure 1:
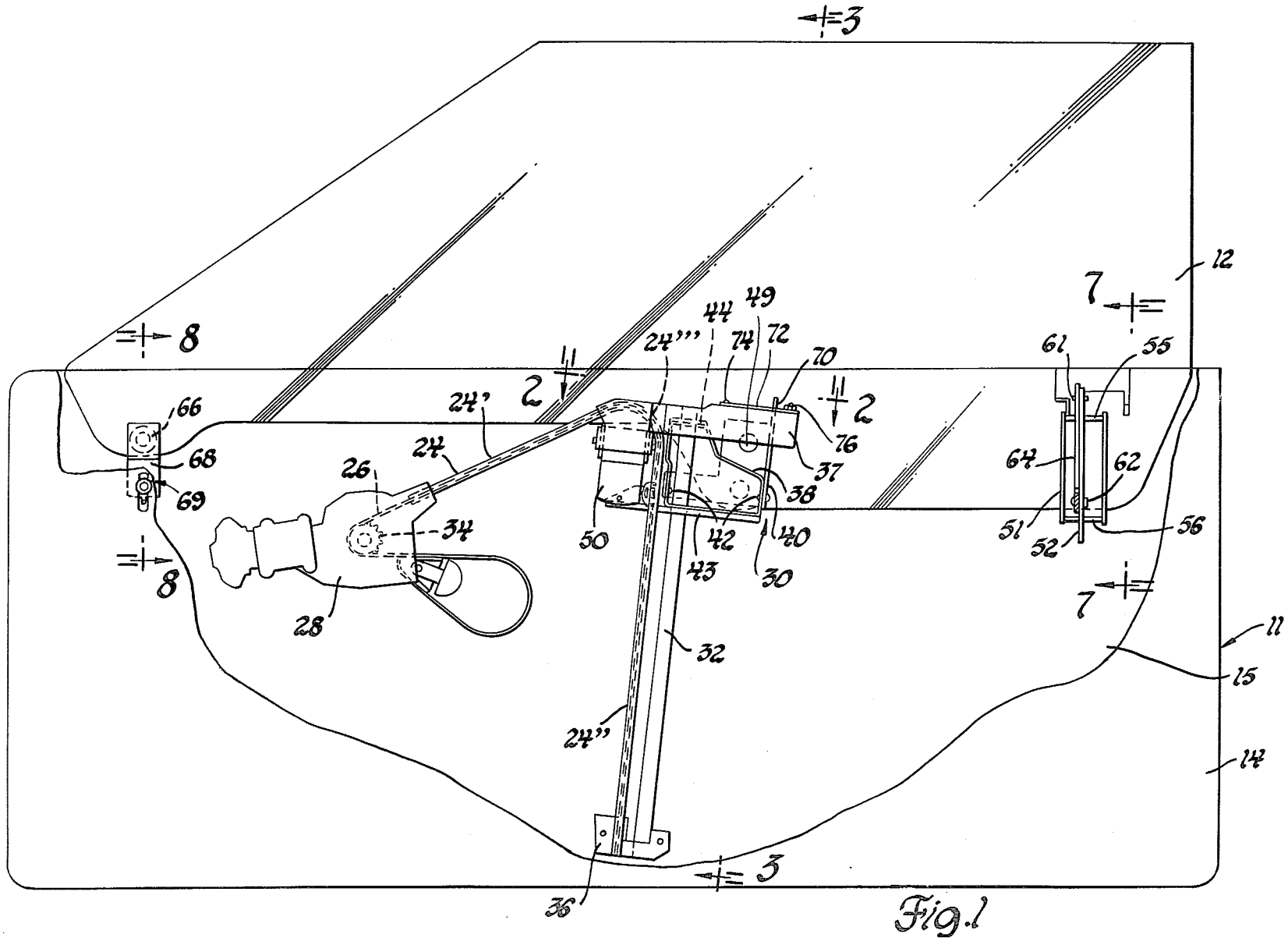
FIG. 1 is an interior elevational view of a door in a hard-top type vehicle having a window assembly according to the present invention and with the inner door panel broken away.
Figure 2:
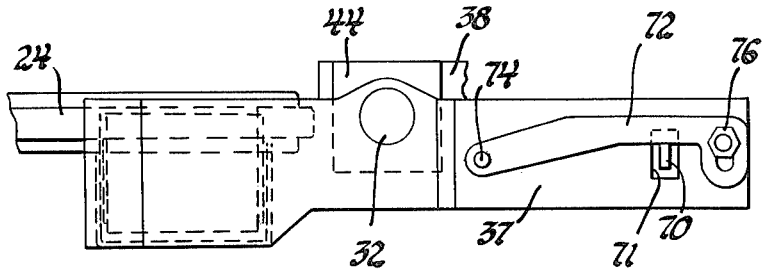
FIG. 2 is an enlarged view taken along the line 2—2 in FIG. 1.
Figure 3:
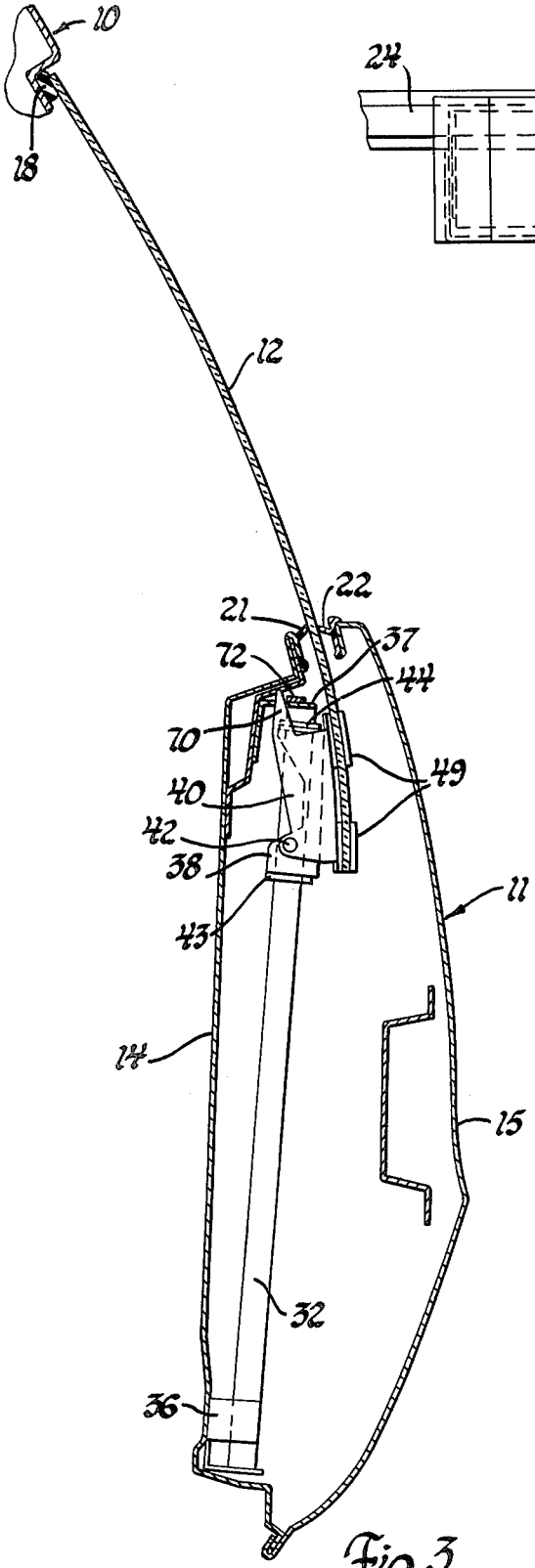
FIG. 3 is an enlarged view taken along the line 3—3 in FIG. 1.

Referring to FIGS. 1 and 3, there is shown a vehicle body 10 of the hard-top type having a door 11 with a window 12 which is mounted between its inner and outer panels 14 and 15 and is movable to open and close a window opening defined by the vehicle body and the belt line of the door. The window 12 is curved and thus requires both vertical and laterally guided movement and in its closed position is required to engage on its interior side and adjacent its peripheral edge above the door's belt line with a seal 18 which is mounted on the vehicle body about the window opening thereof. The window is sealed at the door by a pair of seals 21 and 22 which are mounted on the upper ends of the inner and outer panels 14 and 15 and are slidably contacted by the opposite sides of the window.

The window 12 is provided with a regulator and stabilizer arrangement solely connected between the inner door panel 14 and the window 12 which operates to both move and guide the window in proper relationship to the window opening and also provide lateral stabilization of the window against the seal 18 in its closed position. This is accomplished with a window regulator mechanism having a track 24, a perforated plastic tap 26 slidably mounted in the track, an actuator 28 for driving the tape along the track and a pivotal connector device 30 which connects the tape to the window and is guided on a rigid straight slide pole 32. The actuator 28 is of a conventional type which may either be electric or manually powered and includes a sprocket 34 whose teeth engage the perforated tape 26 to effect its movement in either direction along the track 24 dependent upon the direction the sprocket is caused to turn. The track 24 comprises a pair of straight track sections 24' and 24'' joined by a curved portion 24''' located below the belt line. The track portion 24' is fixed to the actuator 28 and extends at an oblique angle to the belt line while the other straight track portion 24'' extends substantially vertical or perpendicular to the belt line and parallel to the slide pole 32. The lower end of the track portion 24'' and slide pole 32 are fixed to a bracket 36 welded to the inner body panel 14 at a mid point near the lower edge thereof. The curved portion 24''' which is approximately at the mid point of the track and the upper end of the slide pole 32 are fixed to a bracket 37 welded to the inner door panel 14 at a mid point thereof immediately below the belt line.

As shown in FIGS. 1, 3, 5 and 6, the pivotal connector device 30 comprises a pair of yokes 38 and 40 which are pivotally interconnected by a pair of riveted pivot pins 42. The yoke 38 has a lower guide block 43 and an upper guide block 44 which has fixed thereto at spaced locations and have a sliding fit with the slide pole 32 such that the yoke 38 is guided thereby but cannot pivot while the other yoke 40 is pivotal relative thereto about axis located at right angles to the axis of the slide pole. A drive block 45 is also guided in the track 24 and has a plurality of projections 46 along one side which engages perforations near the end of the tape 26. The drive block 45 extends outward of the track and has a slot 47 receiving a tang 48 which is formed integral with the lower guide block 43.

The pivotal yoke 40 is fixed to the window 12 at a mid point adjacent the lower edge thereof by a pair of vertically spaced window fasteners 49. In addition, there is provided a tape spring 50 which is coiled and fixed at one end on the bracket 37 and at its other end is connected to the lower bearing block 43 so that as the window is lowered the spring unwinds to provide a force counterbalancing that of the weight of the window and associated mechanism to minimize the window movement force required. With the arrangement thus far described and on operation of the actuator 28 to drive the tape 26, the window 12 is moved upwardly or downwardly between its open and closed positions in a generally vertical straight path while also being permitted to swing about the generally horizontal axis as provided by the guided yoke 38 on the slide pole 32 and the pivotal yoke 40 pivotally connected to the guided yoke.

Figure 4:
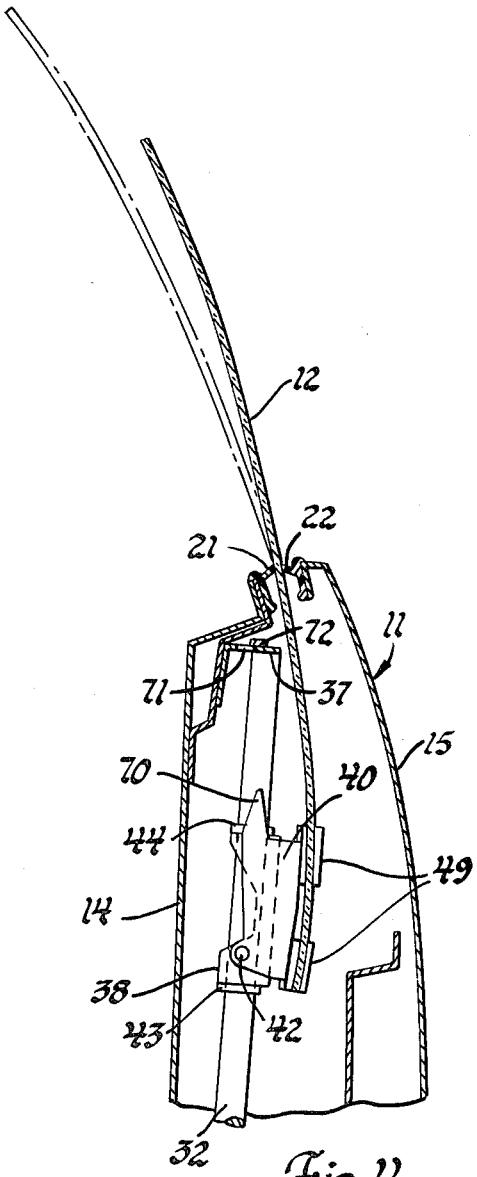
FIG. 4 is a partial view of FIG. 3 but with the window in an intermediate position.
Figure 5:
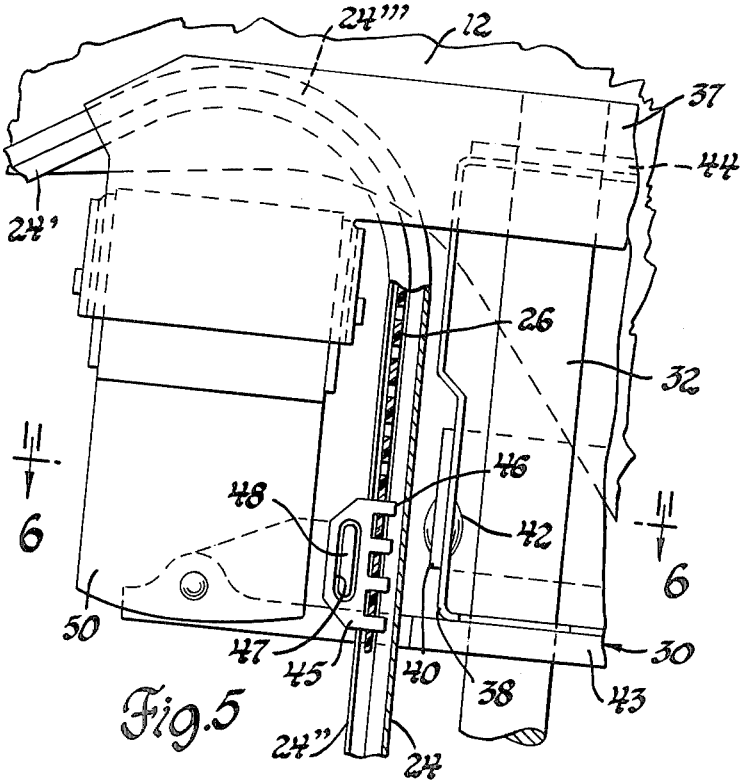
FIG. 5 is an enlarged view of a portion of the window regulator mechanism in FIG. 1.
Figure 6:
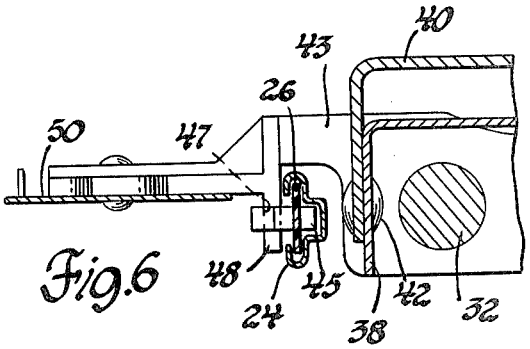
FIG. 6 is a view taken along the line 6—6 in FIG. 5.
Figure 7:
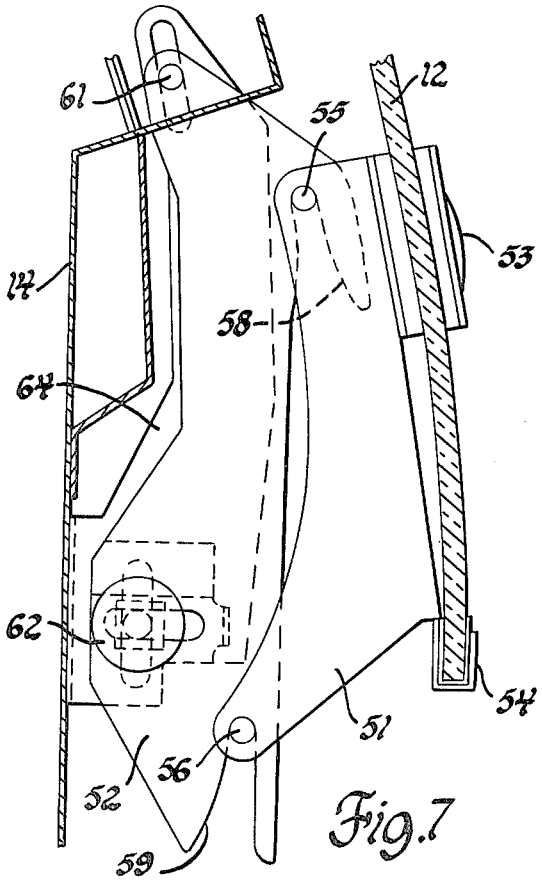
FIG. 7 is an enlarged view taken along the line 7—7 in FIG. 1.
Figure 8:
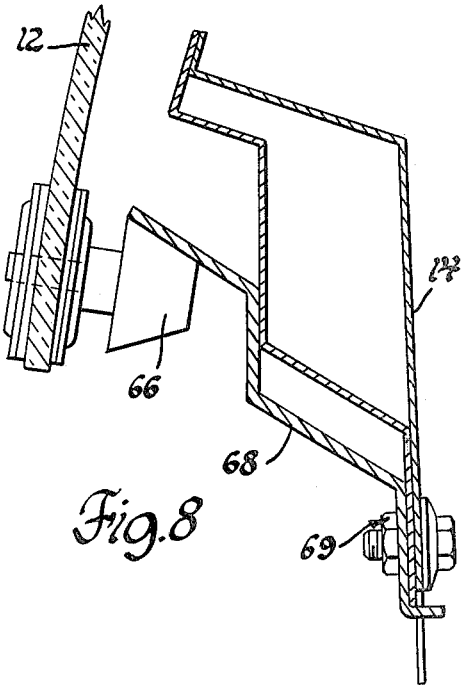
FIG. 8 is an enlarged view taken along the line 8—8 in FIG. 1.

Tilting or swinging movement and also stabilization of the window 12 as it approaches its closed position is provided by a guide bracket 51 and stabilizer bar 52 as shown in FIGS. 1 and 7. The guide bracket 51 is fixed to the window near the rear bottom corner thereof by a window fastener 53 and a flange 54 which is formed integral with the bottom of the bracket and fits over the bottom edge of the window. The bracket 51 extends away from the interior side of the window and has a pair of spaced pins 55 and 56 which are fixed thereto at right angles to the vertical movement of the window. The pins 55 and 56 are engageable as the window approaches its closed position with cam slots 58 and 59 respectively which are formed on the stabilizer bar 52. The stabilizer bar 52 is adjustably fixed by a pin and slot connection 61 and a fastener 62 to a bracket 64 which is welded to the inner door panel 14. The cam slots 58 and 59 are provided with wedge shaped profiles which capture the guide pins 55 and 56 as the window approaches its closed position and then cause the window to swing or tilt laterally at its upper edge as shown in FIG. 4 about an axis perpendicular to its upward path of movement so as to bring the upper window edge against the seal 18 at the roof line as well as engaging the window along its leading and trailing edges against the seal. The stabilizer bar 52 is adjustable with the pin and slot connection 61 and the fastener 62 so that sufficient force is applied by the window against the seal 18 to effect tight sealing thereabout and also serves as both a stop and stabilizer to stop upward movement and prevent lateral outward movement of the window away from the seal on the vehicle body. Another upward stop for the window is provided by a conventional window stop 66 which as shown in FIGS. 1 and 8, is secured to the bottom front corner of the window and is engageable with a stop bracket 68 that is adjustably secured by a bolt and tongue and slot connection 69 to the inner door panel 14.

Additional lateral stabilization of the window in its closed position is provided by a finger 70 which is formed on one arm of the pivotal yoke 40 and is engageable through a slot 71 in the bracket 37 with an adjustable stabilizer finger 72 mounted on the top side of the bracket. The stabilizer finger 72 is pivotally fixed at one end by a pivot connection 74 to the bracket 37 and is adjustably secured at its other end to the bracket by a bolt and slot connection 76. The yoke finger 70 is arranged relative to the stabilizer finger 72 and at right angles to the yoke's pivotal axis and parallel to the slide pole so that as the window 12 approaches its closed position and is guided and stabilized by the guide and stabilizer arrangement 51 and 52, the yoke finger 70 engages the stabilizer finger 72 to prevent the pivotal yoke 40 from clockwise pivoting as viewed in FIG. 3 and thereby prevent lateral movement of the upper edge of the window away from the seal 18. Thus, the window, when in its closed position, is laterally stabilized at two points as provided by the yoke finger 70 and stabilizer finger 72 and by the guide bracket pins 55, 56 and stabilizer bar 52. Furthermore, these two stabilizing points are horizontally spaced generally opposite the ends of the generally horizontal upper edge of the window where it engages the seal along the vehicle roof line which has been found to provide very effective lateral stabilization.

The above described embodiment as illustrative of the invention which may be modified within the scope of the appended claims.

The embodiments of the invention in which an exclusive property or privilege is claimed are defined as follows:

1. In a door having a window arranged between inner and outer panels thereof for opening and closing a window opening cooperatively defined by the door and a vehicle body with an outwardly facing seal, tape drive regulator means connected in said door between said inner panel and said window for moving said window between open and closed positions with respect to said opening comprising a straight slide pole fixed to said inner panel and extending parallel to the direction of movement required of said window in moving across said opening between its open and closed position, actuator means fixed to said inner panel, a track fixed to said inner panel and extending from said actuator means and along said slide pole, a tape slidably mounted in said track and drivingly connected to said actuator means, first yoke means slidably mounted on and guided by said slide pole and drivingly connected to said tape, second yoke means fixed to said window, and pivot means pivotally connecting said second yoke means to said first yoke means so that said window can pivot about an axis transverse to said slide pole to bear against said seal, and combination window guide and lateral stabilizing means on said inner panel and said window operably engageable only during movement of said window adjacent its closed position for guiding said window by camming action to pivotally bear against and then be laterally restrained with respect to said seal as said window is moved to its closed position.

2. In a door having a window arranged between inner and outer panels thereof for opening and closing a window opening cooperatively defined by the door and a vehicle body with an outwardly facing seal, tape drive regulator means connected in said door between said inner panel and said window for moving said window between open and closed positions with respect to said opening comprising a straight slide pole fixed to said inner panel and extending parallel to the direction of movement required of said window in moving across said opening between its open and closed positions, actuator means fixed to said inner panel, a track fixed to said inner panel and extending from said actuator means and along said slide pole, a tape slidably mounted in said track and drivingly connected to said actuator means, first yoke means slidably mounted on and guided by said slide pole and drivingly connected to said tape, second yoke means fixed to said window, and pivot means pivotally connecting said second yoke means to said first yoke means so that said window can pivot about an axis transverse to said slide pole to bear against said seal, combination window guide and lateral stabilizing means on said inner panel and said window operably engageable only during movement of said window adjacent its closed position for guiding said window by camming action to pivotally bear against and then be laterally restrained with respect to said seal as said window is moved to its closed position, and additional lateral stabilizing means on said inner panel and said second yoke means operably engageable only during movement of said window adjacent its closed position for stabilizing said window against said seal as it is moved to its closed position.

3. In a door having a window arranged between inner and outer panels thereof for opening and closing a window opening cooperatively defined by the door and a vehicle body with an outwardly facing seal, tape drive regulator means connected in said door between said inner panel and said window for moving said window between open and closed positions with respect to said opening comprising a straight slide pole fixed to said inner panel and extending parallel to the direction of movement required of said window in moving across said opening between its open and closed positions, actuator means fixed to said inner panel, a track fixed to said inner panel and extending from said actuator means and including a portion extending parallel to said slide pole, a tape slidably mounted in said track and drivingly connected to said actuator means first yoke means including a pair of guide blocks slidably mounted on and guided by said slide pole and drivingly connected to said tape, second yoke means fixed to said window, and pivot means pivotally connecting said second yoke means to said first yoke means so that said window can pivot about an axis transverse to said slide pole to bear against said seal, combination window guide and lateral stabilizing means on said inner panel and said window operably engageable only during movement of said window adjacent its closed position for guiding said window by camming action to pivotally bear against and then be laterally restrained with respect to said seal as said window is moved to its closed position, and additional lateral stabilizing means including finger means on said second yoke means for cooperating with said inner panel only during movement of said window adjacent its closed position to laterally stabilize said window against said seal as it is moved to its closed position.

4. In a door having a window member movable relative to an inner panel member between open and closed positions with respect to a door window opening, regulator means for moving said window between said positions comprising, in combination, a guide member mounted on said inner panel member and defining a path of movement different than the path of movement of the window member, actuator means mounted on said inner panel member, track means mounted on said inner panel member and extending adjacent to said guide member tape means slidably mounted in said track means and drivingly connected to said actuator means, sash plate means secured to said window member and drivingly connected to said tape means, means mounting said sash plate means on said guide member for sliding movement therealong and pivoting movement relative thereto during movement of said window member between said open and closed positions, combination window guide and lateral stabilizing means cooperatively mounted on said inner panel member and said window member for laterally guiding and then fixing said window member in said door window opening as said window moves to said closed position, said combination window guide and lateral stabilizing means comprising first guide means including spaced abutment means fixed to one of said members, second guide means fixed to the other of said members and including spaced open ended slot means receiving said abutment means only during movement of said window member to said closed position to guide said window member by camming action into said closed position and then laterally fix said window member in said closed position with respect to said door window opening.

* * * * *

UNITED STATES PATENT AND TRADEMARK OFFICE

CERTIFICATE OF CORRECTION

PATENT NO. : 4,241,542

DATED : December 30, 1980

INVENTOR(S) : Edward G. Podolan; Francis C. Przybysz

It is certified that error appears in the above—identified patent and that said Letters Patent is hereby corrected as shown below:

Column 1, line 8, "stabilizatin" should be -- stabilization --.

Column 2, line 53, "tap" should be -- tape --.

Column 3, line 12, "has" should be -- are --.

Column 3, lines 18-19, "engages" should be -- engage --.

Column 4, line 37, "as" should be -- is --.

Column 5, line 34, after "for" insert -- laterally --.

Signed and Sealed this

*Twenty-fifth* Day of *August 1981*

[SEAL]

*Attest:*

GERALD J. MOSSINGHOFF

*Attesting Officer*

*Commissioner of Patents and Trademarks*